US008961127B2

(12) United States Patent
Colson et al.

(10) Patent No.: US 8,961,127 B2
(45) Date of Patent: Feb. 24, 2015

(54) SHAFT CAP

(75) Inventors: Darryl A. Colson, West Suffield, CT (US); Craig M. Beers, Wethersfield, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 650 days.

(21) Appl. No.: 13/279,529

(22) Filed: Oct. 24, 2011

(65) Prior Publication Data

US 2013/0101435 A1 Apr. 25, 2013

(51) Int. Cl.
*F01D 25/00* (2006.01)
*F04D 29/26* (2006.01)

(52) U.S. Cl.
CPC ..... *F04D 29/266* (2013.01)
USPC ..... 415/216.1; 415/229; 416/174; 416/244 A

(58) Field of Classification Search
CPC ... F04D 19/002; F04D 25/06; F04D 25/0606; F04D 25/08; F04D 25/082; F04D 25/05; F04D 25/053; F04D 25/054; F04D 25/26; F04D 25/263; F04D 25/266
USPC ..... 403/202, 300; 415/216.1, 229; 416/174, 416/244 R, 244 A
See application file for complete search history.

(56) References Cited

U.S. PATENT DOCUMENTS 1,940,466 A 12/1933 Sneed
2,527,229 A 10/1950 Roubal
2,752,515 A 6/1956 Baudry et al.
3,410,029 A 11/1968 Savage
3,433,020 A 3/1969 Earle, Jr. et al.
3,588,044 A 6/1971 Reichrath et al.
3,763,835 A 10/1973 Miller et al.
3,915,024 A 10/1975 Mort
3,949,550 A 4/1976 Albrecht et al.
3,999,872 A 12/1976 Allison
4,012,154 A 3/1977 Durwin et al.
4,247,256 A * 1/1981 Maghon ..... 416/198 A
4,439,106 A 3/1984 Ferris et al.
4,511,193 A 4/1985 Geczy
4,543,785 A 10/1985 Patrick
4,979,872 A 12/1990 Myers et al.
5,239,815 A 8/1993 Barcza
5,505,587 A 4/1996 Ghetzler
5,529,316 A 6/1996 Mattila
5,683,184 A 11/1997 Striedacher et al.
6,299,077 B1 10/2001 Harmon et al.
6,380,647 B2 4/2002 Hayashi et al.
6,499,969 B1 * 12/2002 Tombers et al. ..... 417/407

(Continued)

OTHER PUBLICATIONS

Colson et al., U.S. Appl. No. 13/279,588, filed Oct. 24, 2011.

(Continued)

*Primary Examiner* — Edward Look
*Assistant Examiner* — Juan G Flores
(74) *Attorney, Agent, or Firm* — Kinney & Lange, P.A.

(57) ABSTRACT

A shaft cap to connect between a shaft and a tie rod on a rotative assembly includes a circular portion with a central opening for connecting to the tie rod; a conical portion extending out from the circular portion at a slope; and a pilot around the outer edge of the conical portion. The pilot includes an outer lip to connect to an end of the shaft, an inner portion to connect to the inner circumference of the shaft and an undercut portion between the outer lip and the inner portion.

20 Claims, 7 Drawing Sheets

(56) References Cited

U.S. PATENT DOCUMENTS

| | | | |
|---|---|---|---|
| 6,698,933 | B2 | 3/2004 | Lau |
| 6,926,490 | B2 | 8/2005 | McAuliffe et al. |
| 6,928,963 | B2 | 8/2005 | Karanik |
| 6,966,174 | B2 | 11/2005 | Paul |
| 7,165,939 | B2 | 1/2007 | Chen et al. |
| 7,342,332 | B2 | 3/2008 | McAuliffe et al. |
| 7,394,175 | B2 | 7/2008 | McAuliffe et al. |
| 7,397,145 | B2 | 7/2008 | Struve et al. |
| 7,757,502 | B2 | 7/2010 | Merritt et al. |
| 7,952,241 | B2 | 5/2011 | Kato et al. |
| 2002/0171218 | A1 | 11/2002 | Bell |
| 2006/0061221 | A1 | 3/2006 | McAuliffe et al. |
| 2010/0055383 | A1 | 3/2010 | Schalla et al. |

OTHER PUBLICATIONS

Colson et al., U.S. Appl. No. 13/279,538, filed Oct. 24, 2011.
Rosen et al., U.S. Appl. No. 13/279,488, filed Oct. 24, 2011.
Binek et al., U.S. Appl. No. 13/1279,497, filed Oct. 24, 2011.
Binek et al., U.S. Appl. No. 13/1279,508, filed Oct. 24, 2011.
Chrabascz et al., U.S. Appl. No. 13/1279,523, filed Oct. 24, 2011.
Chrabascz et al., U.S. Appl. No. 13/1279,534, filed Oct. 24, 2011.
Rosen et al., U.S. Appl. No. 13/279,576, filed Oct. 24, 2011.

* cited by examiner

SHAFT CAP

BACKGROUND

The present invention relates to an environmental control system. In particular, the invention relates to a ram air fan assembly for an environmental control system for an aircraft.

An environmental control system (ECS) aboard an aircraft provides conditioned air to an aircraft cabin. Conditioned air is air at a temperature, pressure, and humidity desirable for aircraft passenger comfort and safety. At or near ground level, the ambient air temperature and/or humidity is often sufficiently high that the air must be cooled as part of the conditioning process before being delivered to the aircraft cabin. At flight altitude, ambient air is often far cooler than desired, but at such a low pressure that it must be compressed to an acceptable pressure as part of the conditioning process. Compressing ambient air at flight altitude heats the resulting pressurized air sufficiently that it must be cooled, even if the ambient air temperature is very low. Thus, under most conditions, heat must be removed from air by the ECS before the air is delivered to the aircraft cabin. As heat is removed from the air, it is dissipated by the ECS into a separate stream of air that flows into the ECS, across heat exchangers in the ECS, and out of the aircraft, carrying the excess heat with it. Under conditions where the aircraft is moving fast enough, the pressure of air ramming into the aircraft is sufficient to move enough air through the ECS and over the heat exchangers to remove the excess heat.

While ram air works well under normal flight conditions, at lower flight speeds, or when the aircraft is on the ground, ram air pressure is too low to provide enough air flow across the heat exchangers for sufficient heat removal from the ECS. Under these conditions, a fan within the ECS is employed to provide the necessary airflow across the ECS heat exchangers. This fan is called a ram air fan.

As with any system aboard an aircraft, there is great value in an improved ram air fan that includes innovative components designed to improve the operational efficiency of the ram air fan or to reduce its weight.

SUMMARY

A shaft cap to connect between a shaft and a tie rod on a rotative assembly includes a circular portion with a central opening for connecting to the tie rod; a conical portion extending out from the circular portion at a slope; and a pilot around the outer edge of the conical portion. The pilot includes an outer lip to connect to an end of the shaft, an inner portion to connect to the inner circumference of the shaft and an undercut portion between the outer lip and the inner portion.

DETAILED DESCRIPTION

Figure 1:
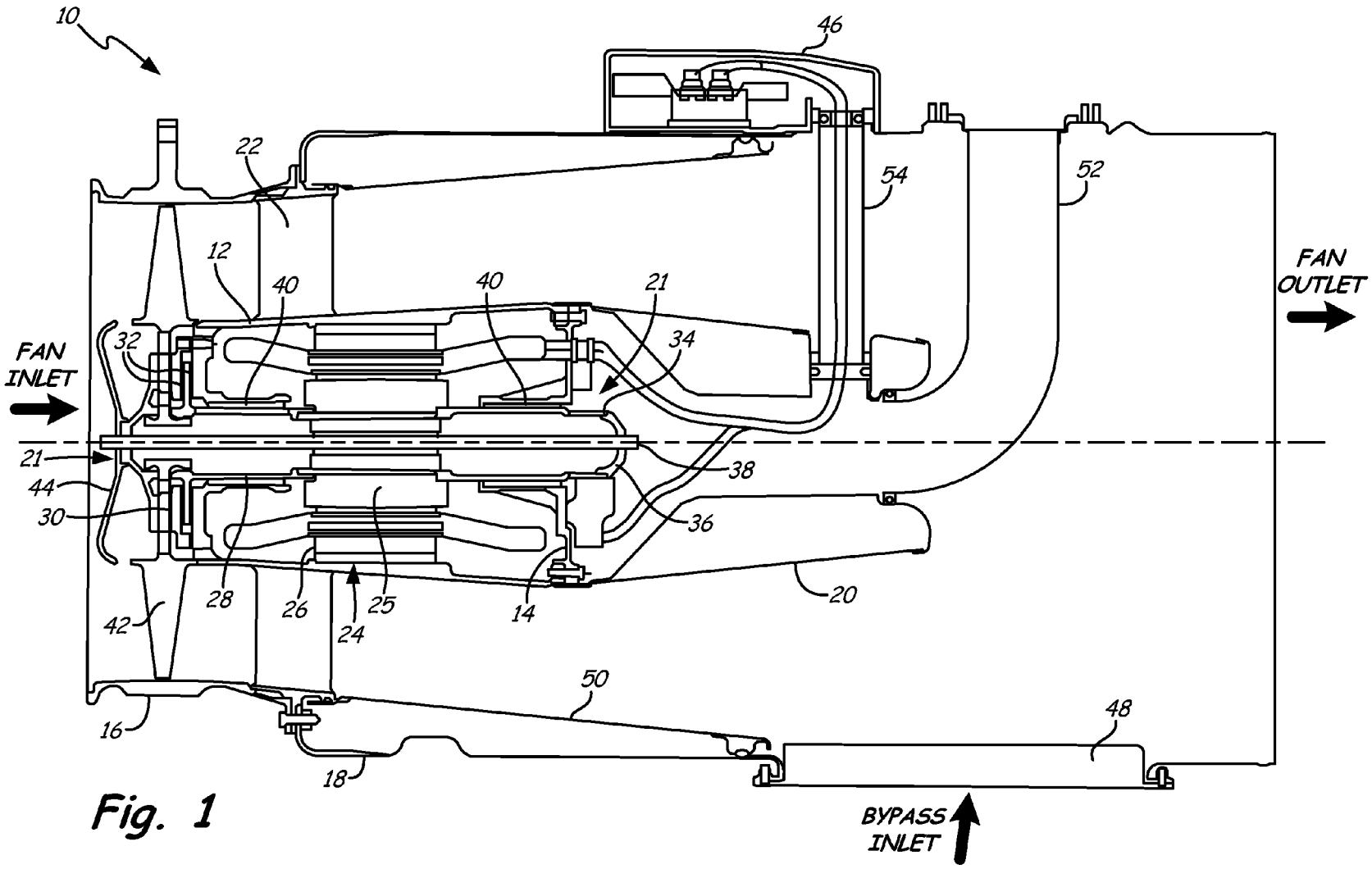
FIG. 1 is cross-sectional view of a ram air fan assembly.

FIG. 1 illustrates a ram fan air assembly incorporating the present invention. Ram air fan assembly 10 includes fan housing 12, bearing housing 14, inlet housing 16, outer housing 18, inner housing 20 and fan rotative assembly 21. Fan housing 12 includes fan struts 22, motor 24 (including motor rotor 25 and motor stator 26), thrust shaft 28, thrust plate 30, and thrust bearings 32. Bearing housing 14 includes journal bearing shaft 34 and shaft cap 36. Fan housing 12 and bearing housing 14 together include tie rod 38 and journal bearings 40. Inlet housing 16 contains fan rotor 42 and inlet shroud 44, in addition to a portion of tie rod 38. Outer housing 18 includes terminal box 46 and plenum 48. Within outer housing 18 are diffuser 50, motor bearing cooling tube 52, and wire transfer tube 54. Rotative assembly 21 includes motor rotor 25, thrust shaft 28, bearing shaft 34, shaft cap 36, inlet shroud 44 and tie rod 38. A fan inlet is a source of air to be moved by ram air fan assembly 10 in the absence of sufficient ram air pressure. A bypass inlet is a source of air to that moves through ram air fan assembly 10 when sufficient ram air pressure is available.

As illustrated in FIG. 1, inlet housing 16 and outer housing 18 are attached to fan housing 12 at fan struts 22. Bearing housing 14 is attached to fan housing 12 and inner housing 20 connects motor bearing cooling tube 52 and wire transfer tube 54 to bearing housing 14. Motor bearing cooling tube 52 connects inner housing 20 to a source of cooling air at outer housing 18. Wire transfer tube 54 connects inner housing 20 to outer housing 18 at terminal box 46. Motor stator 26 and thrust plate 30 attach to fan housing 12. Motor rotor 25 is contained within motor stator 26 and connects journal bearing shaft 34 to thrust shaft 28. Journal bearing shaft 34, motor rotor 25, and thrust shaft 28 define an axis of rotation for ram fan assembly 10. Fan rotor 42 is attached to thrust shaft 28 with tie rod 38 extending along the axis of rotation from shaft cap 36 at the end of journal bearing shaft 34 through motor rotor 25, thrust shaft 28, and fan rotor 42 to inlet shroud 44. Nuts (see FIGS. 2A-2B) secure shaft cap 36 to journal bearing shaft 34 on one end of tie rod 38 and inlet shroud 44 to fan rotor 42 at opposite end of tie rod 38. Thrust plate 30 and fan housing 12 contain a flange-like portion of thrust shaft 28, with thrust bearings 32 positioned between the flange-like portion of thrust shaft 28 and thrust plate 30; and between the flange-like portion of thrust shaft 28 and fan housing 12. Journal bearings 40 are positioned between journal bearing shaft 24 and bearing housing 14; and between thrust shaft 28 and fan housing 12. Inlet shroud 44, fan rotor 42, and a portion of fan housing 12 are contained within inlet housing 16. Diffuser 50 is attached to an inner surface of outer housing 18. Plenum 48 is a portion of outer housing 18 that connects ram air fan assembly 10 to the bypass inlet. Inlet housing 16 is connected to the fan inlet and outer housing 18 is connected to the fan outlet.

In operation, ram air fan assembly 10 is installed into an environmental control system aboard an aircraft and connected to the fan inlet, the bypass inlet, and the fan outlet. When the aircraft does not move fast enough to generate sufficient ram air pressure to meet the cooling needs of the ECS, power is supplied to motor stator 26 by wires running from terminal box 46, through wire transfer tube 54, inner housing 20, and bearing housing 14.

Energizing motor stator 26 causes rotor 25 to rotate about the axis of rotation of ram fan assembly 10, rotating rotative assembly 21. Motor rotor 25 rotates connected journal bearing shaft 34 and thrust shaft 28. Fan rotor 42 and inlet shroud 44 also rotate by way of their connection to thrust shaft 28. Tie rod 38 ensures that rotative assembly 21 rotates uniformly together by connecting to inlet shroud 44 and to shaft cap 36 of rotative assembly 21. Journal bearings 40 and thrust bearings 32 provide low friction support for the rotating components. As fan rotor 42 rotates, it moves air from the fan inlet, through inlet housing 20, past fan struts 22 and into the space between fan housing 12 and outer housing 18, increasing the air pressure in outer housing 18. As the air moves through outer housing 18, it flows past diffuser 50 and inner housing 20, where the air pressure is reduced due to the shape of diffuser 50 and the shape of inner housing 20. Once past inner housing 20, the air moves out of outer housing 18 at the fan outlet. Components within bearing housing 14 and fan housing 12, especially thrust bearings 32, journal bearings 40, motor stator 26, and motor rotor 24; generate significant heat and must be cooled. Cooling air is provided by motor bearing cooling tube 52 which directs a flow of cooling air to inner housing 20. Inner housing 20 directs flow of cooling air to bearing housing 14, where it flows past components in bearing housing 14 and fan housing 12, cooling the components. Once the aircraft moves fast enough to generate sufficient ram air pressure to meet the cooling needs of the ECS, ram air is directed into plenum 48 from the bypass inlet. The ram air passes into outer housing 18 at plenum 48 and moves out of outer housing 18 at the fan outlet.

Figure 2A:
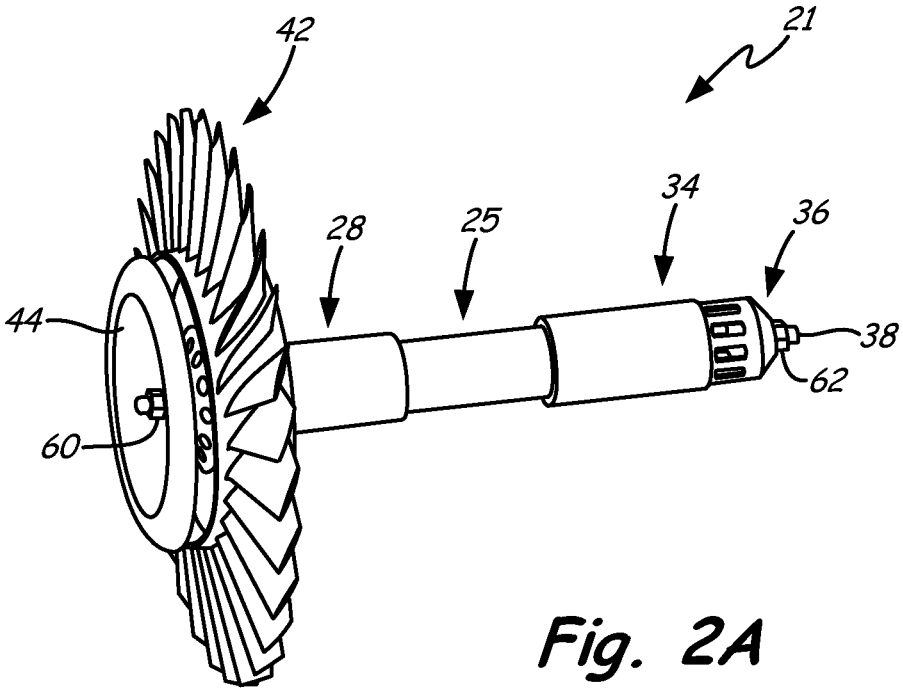
FIG. 2A shows a perspective view of a rotative assembly for a ram air fan.
Figure 2B:
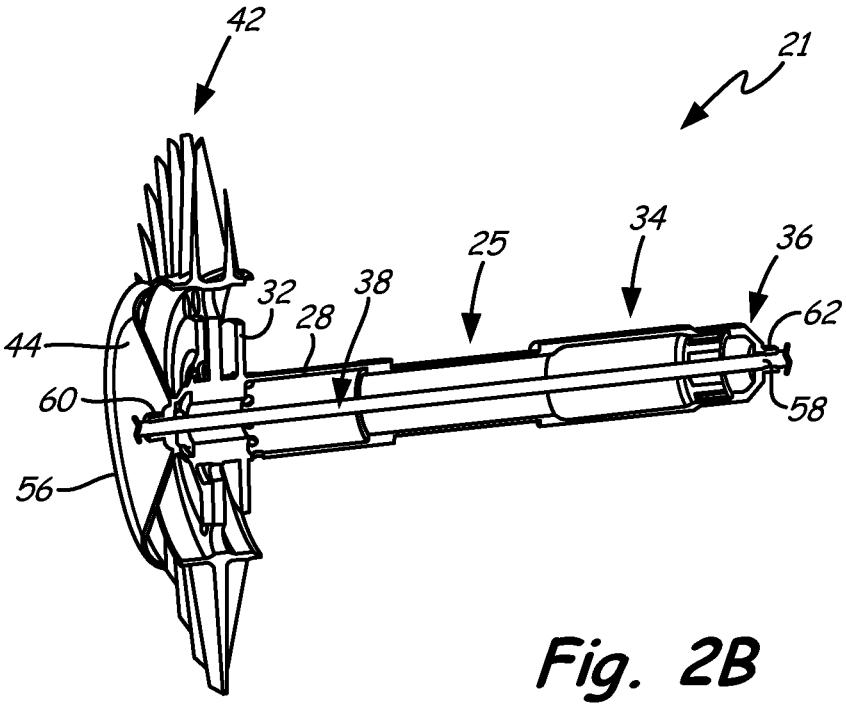
FIG. 2B shows a cross sectional view of FIG. 2A.

FIG. 2A shows a perspective view of rotative assembly 21 for ram air fan 10. FIG. 2B shows a cross sectional view of FIG. 2A. FIGS. 2A-2B include thrust shaft 28, thrust bearings 32, journal bearing shaft 34, shaft cap 36, tie rod 38 (with first end 56 and second end 58), fan rotor 42, inlet shroud 44, first nut 60 and second nut 62.

Fan inlet shroud 44 is connected to tie rod 38 at first end 56. Nut 60 connects to tie rod 38 adjacent to inlet shroud 44. Inlet shroud connects to fan rotor 42, which connects to thrust shaft 28 Thrust shaft 28 connects to motor rotor 25, which connects to journal bearing shaft 34. Journal bearing shaft 34 connects securely to shaft cap 36, which connects to second end 58 of tie rod 38. Second nut 62 secures to second end 58 of tie rod 38 adjacent to shaft cap 36.

When ram air fan 10 is in operation, thrust shaft 28, journal bearing shaft 34, shaft cap 36, tie rod 38, fan rotor 42 and inlet shroud 44 all rotate together. Tie rod 38 connects the ends of rotative assembly 21 (inlet shroud 44 and shaft cap 36) with a pre-load force to ensure secure connections between all parts of rotative assembly 21. These secure connections work to guarantee uniform rotation between parts of rotative assembly 21. Simultaneous rotation is essential to ensure that rotative assembly 21 is functioning properly as well as to extend the life of parts of rotative assembly 21. Parts are susceptible to degradation and wear when they are not rotating as one. The preload force on tie rod 38 can be about 4000 pounds.

Past systems generally included tie rods that had a central support connecting tie rod 38 to motor rotor 25 or shafts (34, 28). Tie rod 38 of the current invention is dimensioned so that no additional supports are needed, saving weight and cost of adding supports in rotative assembly 21. Additionally, the lack of need for another support ensures tie rod 38 does not block cooling flow through rotative assembly 21.

Figure 3:
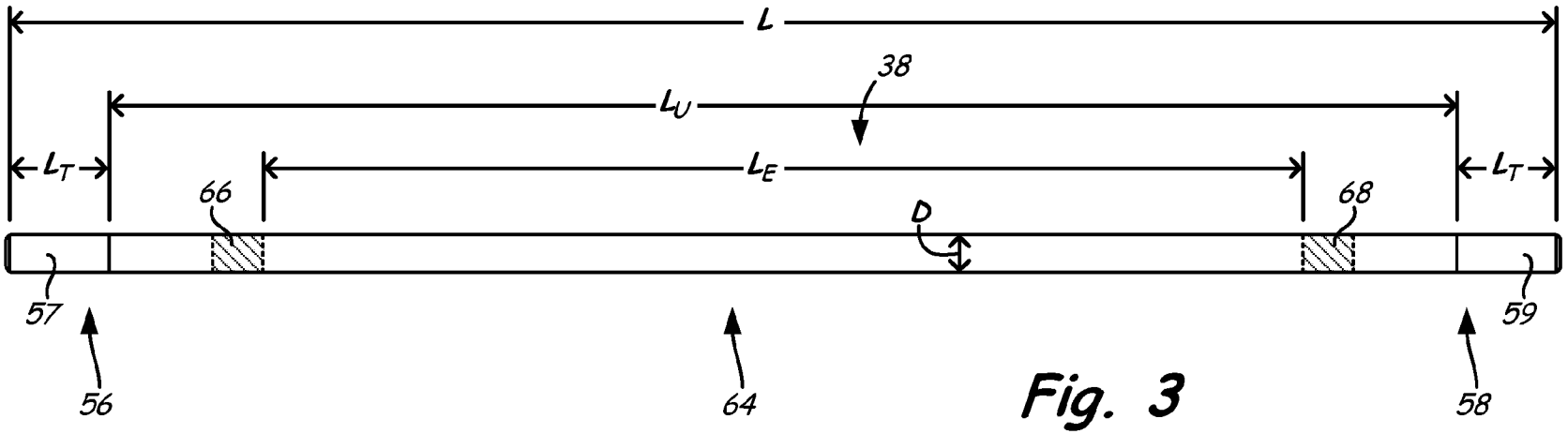
FIG. 3 shows a perspective view of a tie rod.

FIG. 3 shows a view of tie rod 38 with dimensions. Tie rod 38 includes a first end 56 with threads 57, a second end 58 with threads 59, an elongated central portion 64, portion 66 for inlet shroud 44 connection and portion 68 for shaft cap 36 connection. Tie rod 38 is circular with a diameter D and can be made of titanium. Dimensions of tie rod 38 include: full length L, length of threads $L_T$, length of unthreaded portion $L_U$ and length $L_E$ of elongated portion extending between connection 68 to shaft cap 36 and connection 66 to inlet shroud 44.

On first end 56 of tie rod 38, threads 57 extend a length of threads $L_T$ of about 0.97 inches (24.638 mm) to about 1.03 inches (26.162 mm) from first end 56. Portion 66 for fan inlet shroud 44 connection can be about 0.5 inches (12.7 mm) axially and go from about 2.0 inches (50.8 mm) to about 2.5 inches (63.5 mm) from first end 56. Total length L of tie rod 38 from first end 56 to second end 58 can be about 15.06 inches (382.524 mm) to about 15.12 inches (384.048 mm). Diameter D of tie rod can be about 0.3695 inches (9.385 mm) to about 0.3705 inches (9.411 mm). On second end 58 of tie rod 38 threads 59 extend axially about 0.97 inches (24.638 mm) to about 1.03 inches (26.162 mm) from end 58. Portion 68 for shaft cap 36 connection can be about 0.5 inches (12.7 mm) axially and go from about 2.0 inches (50.8 mm) to about 2.5 inches (63.5 mm) from second end 58. Length $L_E$ of elongated portion between portion 66 and portion 68 can be about 10.06 inches (255.524 mm) to about 10.12 inches (257.048 mm). Unthreaded length $L_U$ of tie rod 38 can be about 13.06 inches (331.724 mm) to about 13.12 inches (333.248 mm). The diameter to length ratio of tie rod 38 can be about 1:40.810 to about 1:40.768.

As mentioned above, tie rod 38 is dimensioned with a specific length L, unthreaded length $L_U$, length $L_E$ between portions (66, 68) to shaft cap 36 and inlet shroud 44 and diameter D so that no additional supports are needed for tie rod 38. Specific dimensions, including a unique length L to diameter D ratio, are also carefully selected to prevent tie rod 38 from having resonant modes within system operating ranges. Rotating machinery, such as ram air fans, have specific operating ranges, for example 20,000 RPM. If the frequency at which rotative assembly 21 is spinning is the same frequency as a system operating mode, tie rod 38 will resonate and vibrate. This vibration introduces unbalance into rotative assembly 21, placing high loads onto rotative assembly 21 parts and bearings 32, 40. These high loads can cause degredation of parts and possible part failures.

Figure 4A:
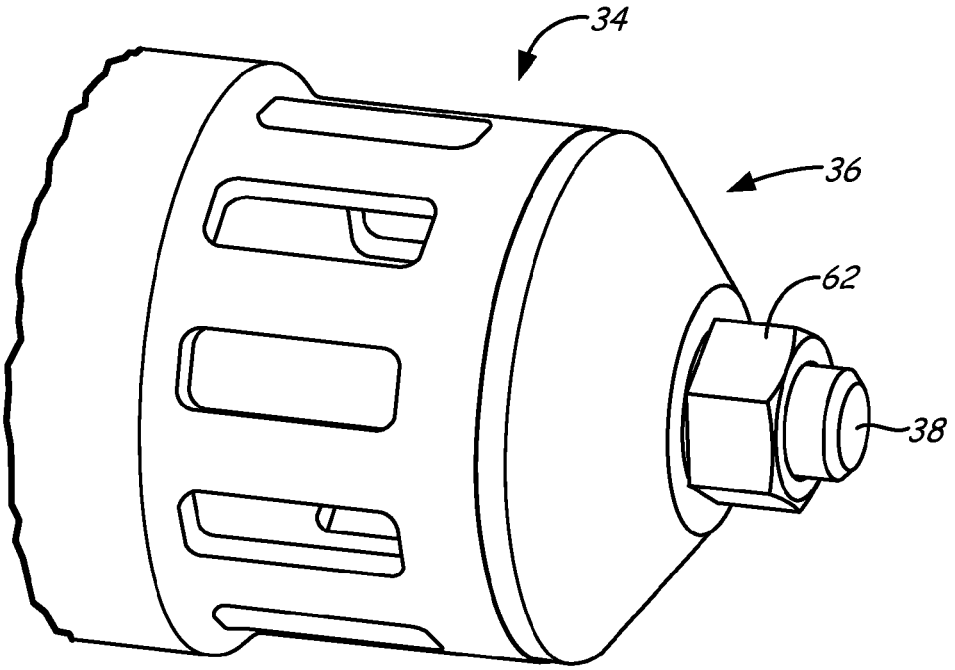
FIG. 4A shows a perspective view of an end the rotative assembly.
Figure 4B:
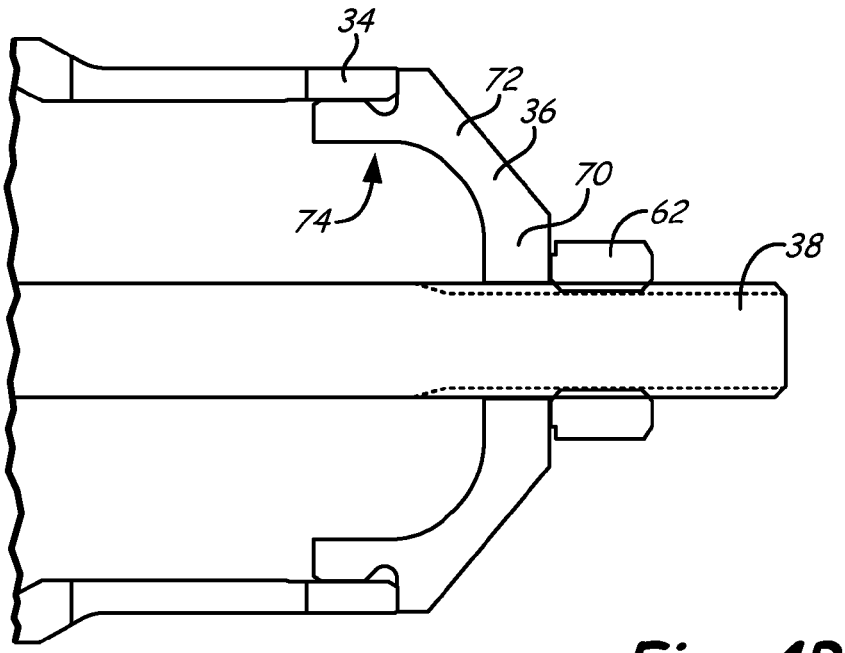
FIG. 4B shows a cross sectional view of FIG. 4A.

FIG. 4A shows a perspective view of an end of rotative assembly 21 for ram air fan 10. FIG. 4B shows a cross sectional view of FIG. 4A. FIGS. 4A-4B include journal bearing shaft 34, shaft cap 36 (with circular portion 70, conical portion 72 and pilot 74), tie rod 38 and nut 62.

Shaft cap 36 connects securely to shaft 34 at pilot 74 through an interference fit (the outer diameter of pilot 74 is larger than the inner diameter of shaft 34). Shaft cap 36 connects to tie rod 38 at circular portion 70. Nut 62 threads on tie rod 38 to securely hold shaft cap 36 on tie rod 38. When ram air fan 10 is in operation, tie rod 38, shaft cap 36 and shaft 34 rotate together. This simultaneous rotation is essential to ensure the rotative assembly 21 is functioning properly as well as to extend the life of parts of rotative assembly 21. Parts are susceptible to degradation and wear when they are off balance and do not rotate together.

Making shaft cap 36 separately from shaft 34 allows for a less expensive and easier manufacturing process. Past systems manufactured shaft 34 and shaft cap 36 as one part. Due to the complex geometry, machining shaft with holes and cap section with a conical portion and central hole for a tie rod was very difficult and costly. Machining shaft cap 36 and shaft 34 separately and using an interference fit to secure them together results in parts that are easier and less expensive to make while still having a strong connection to rotate together under system operating conditions.

Machining shaft cap 36 separately also allows for the machining of a more angled conical section (than could be made if cap 36 and shaft 34 were machined as one part). As mentioned in relation to FIG. 1, there is a cooling airflow through the rotative assembly 21 for cooling of motor 24 and bearings 32, 40. This cooling airflow can sometimes carry debris with it. A more angled conical section 72 of shaft cap 36 can deflect debris from entering slots in shaft 34, which could lead to build-up that may affect performance and life of shaft 34.

Figure 5A:
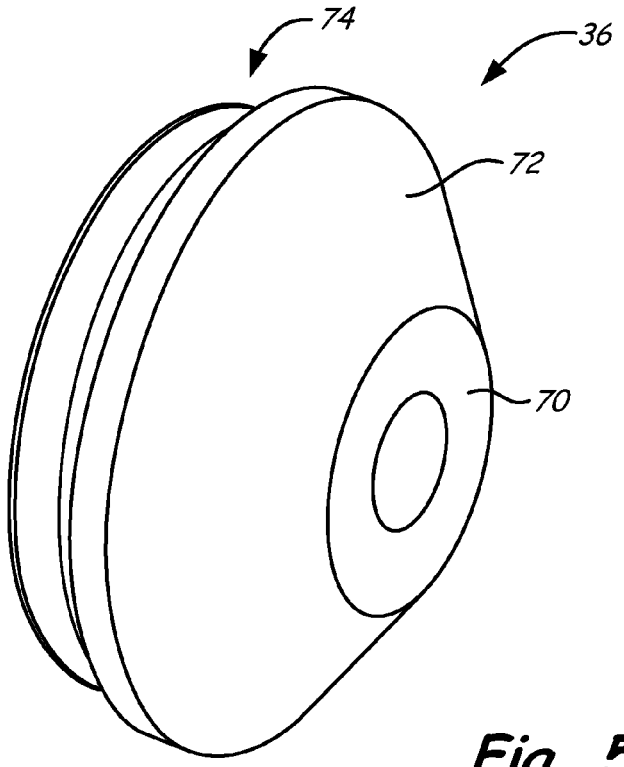
FIG. 5A shows a perspective view of an outer side of a shaft cap for a rotative assembly.
Figure 5B:
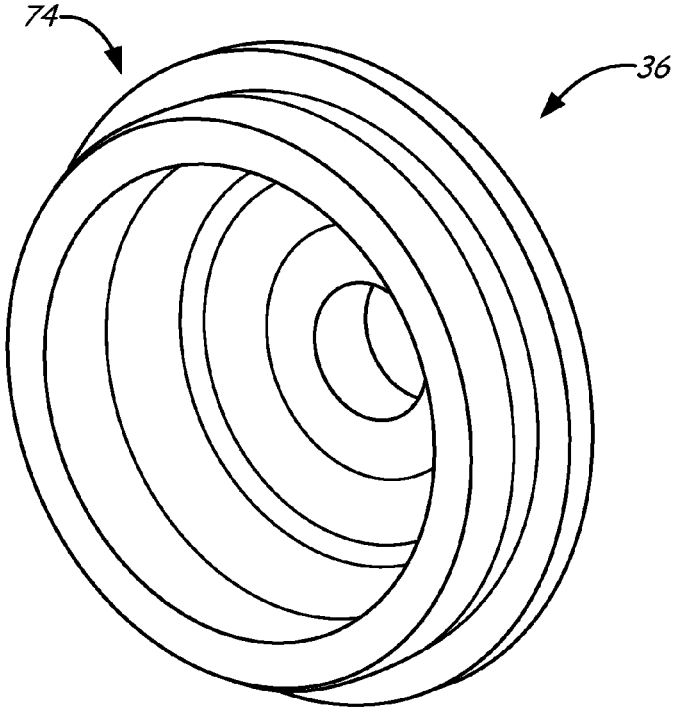
FIG. 5B shows a perspective view of an inside of the shaft cap of FIG. 5A.
Figure 5C:
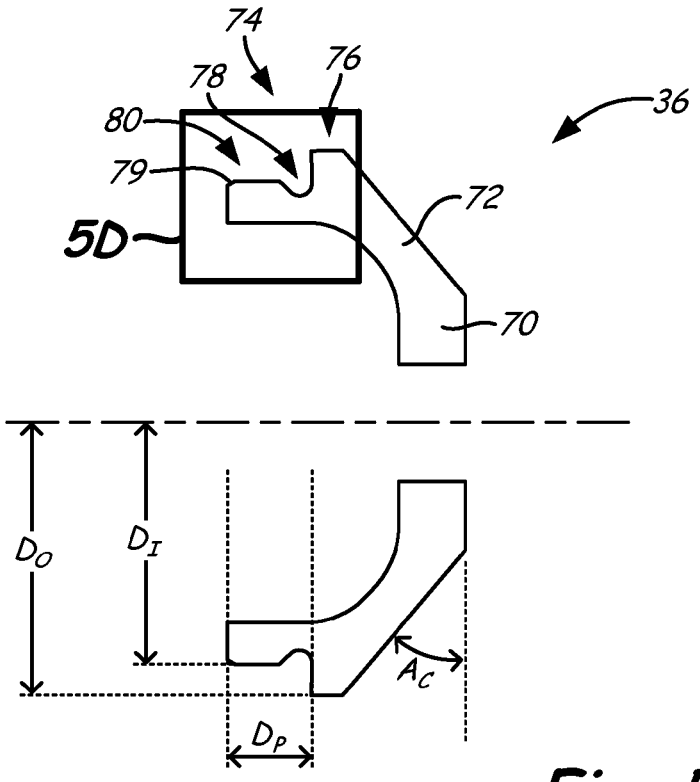
FIG. 5C shows a cross-sectional view of the shaft cap of FIG. 5A.
Figure 5D:
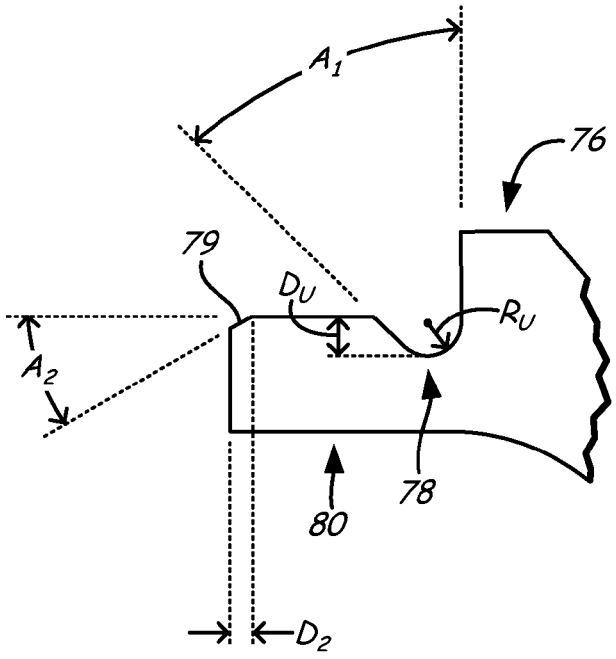
FIG. 5D shows a close up view of section D of FIG. 5C.

FIG. 5A shows a perspective view of an outer side of shaft cap 36 for rotative assembly 21. FIG. 5B shows a perspective view of an inside of shaft cap 36. FIG. 5C shows a cross-sectional view of shaft cap 36. FIG. 5D shows a close up view of section 5D of FIG. 5C.

FIGS. 5A-5D include shaft cap 36 with circular portion 70, conical portion 72 and pilot 74. Pilot 74 includes outer lip 76, undercut portion 78 and inner portion 80 (with slanted edge 79). Shaft cap 36 can be machined from one piece of metal, for example stainless steel. Dimensions shown are: radial distance $D_I$ between center axis of shaft cap 36 and edge of inner portion 80; radial distance $D_O$ between center axis of shaft cap 36 and edge of outer lip 76 (or conical section 72); angle $A_C$ of conical section; angle $A_1$ between outer lip 76 and undercut portion 78 of pilot 74; Depth $D_U$ of undercut portion 78; Radius $R_U$ of undercut portion 78; axial distance $D_P$ between outer lip 76 and end of inner portion 80; distance axially of slanted edge $D_2$; and angle $A_2$ of slanted edge at inner portion 80 of pilot 74.

Radial distance $D_I$ between center axis of shaft cap 36 and edge of inner portion 80 can be about 1.5655 inches (39.764 mm) to about 1.5665 inches (39.789 mm). Radial distance $D_o$ between center axis of shaft cap 36 and edge of outer lip 76 (or conical section 72) can be about 1.759 inches (44.679 mm) to about 1.761 inches (44.729 mm). Angle $A_c$ of conical section can be about 48 degrees to about 52 degrees. Angle $A_1$ between outer lip 76 and undercut portion 78 of pilot 74 can be about 43 degrees to about 47 degrees. Radius $R_u$ of undercut portion 78 can be about 0.035 inches (0.889 mm) to about 0.045 inches (1.143 mm). Depth $D_u$ of undercut portion 78 can be about 0.042 inches (1.067 mm) to about 0.052 inches (1.321 mm). Axial distance $D_p$ between outer lip 76 and end of inner portion 80 can be about 0.265 inches (6.731 mm) to about 0.275 inches (6.985 mm). Axial distance of slanted edge $D_2$; can be about 0.030 inches (0.762 mm). Angle $A_2$ of slanted edge at inner portion 80 of pilot 74 can be about 28 degrees to about 32 degrees.

Dimensions of pilot 74 are key to providing an interference connection between shaft cap 36 and shaft 34 under all operating conditions. Dimensions must be precise, as system operating conditions can range from temperatures of about negative 65 degrees F. up to about 200 degrees F. These extreme temperature changes can cause shaft cap 36 to expand or contract slightly, but must not affect the connection between shaft 34 and shaft cap 36. Undercut portion 78 is a semi-circular recess around the pilot 74, and acts as a stress relief in the connection between shaft 34 and shaft cap 36. Undercut 78 ensures that the interference fit does not cause pilot 74 to crack when shaft cap 36 may expand under high operating temperatures.

Figure 6:
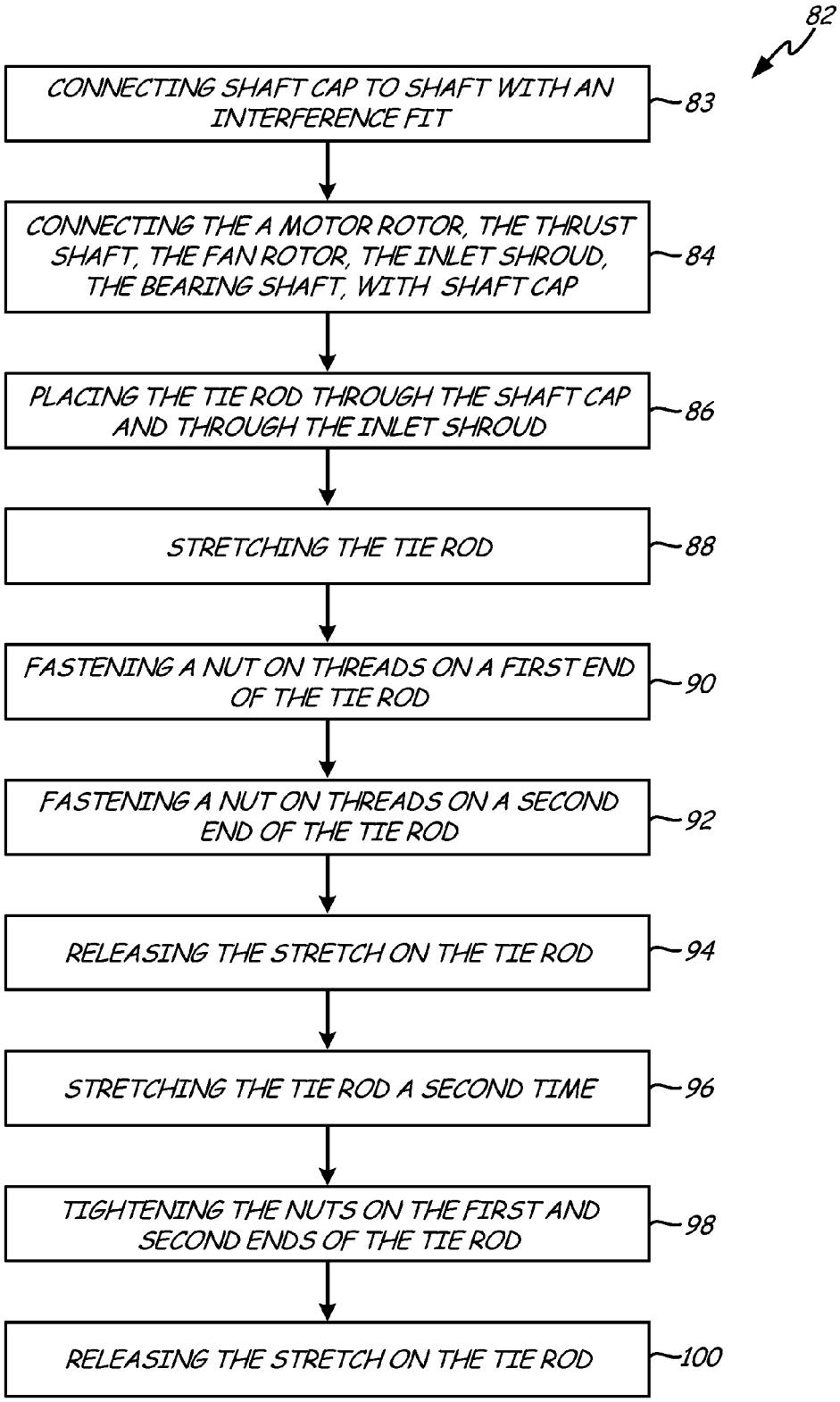
FIG. 6 shows a block diagram of a method of installing a tie rod into a rotative assembly of a ram air fan.

FIG. 6 shows a block diagram of method 82 of assembling rotative assembly 21 of a ram air fan 10. Method 82 includes steps of: connecting shaft cap 36 to shaft 34 with an interference fit (step 83); connecting motor rotor 25, thrust shaft 28, fan rotor 42, inlet shroud 44, bearing shaft 34 and shaft cap 36 (step 84), placing tie rod 38 through shaft cap 36 and through the inlet shroud 44 (step 86); stretching tie rod 38 (step 88); fastening nut 60 on threads on first end 56 of the tie rod 38 (step 90); fastening nut 62 on the threads on second end 58 of tie rod 38 (step 92); releasing the stretch on tie rod 38 (step 94); stretching tie rod 38 a second time (step 96); tightening nuts 60, 62 on the first and second ends 56, 58 of tie rod 38 (step 98); and releasing the stretch on tie rod 38 (step 100).

Connecting the shaft cap to the shaft with an interference fit (step 83) can be done by first shrinking shaft cap, for example by immersing shaft cap 36 in liquid nitrogen, causing shaft cap 36 to freeze and contract or by utilizing a hydraulic press. Then shaft cap 36 is placed in an end of shaft 34 so that inner portion 80 and undercut portion 78 of pilot 74 are inside shaft 34. Slanted edge 79 can assist in easing shaft cap 36 into shaft 34. Shaft cap 36 is then allowed to expand and return to its normal state to form a secure connection with shaft 34. Step 83 forms a secure connection between shaft cap 36 and shaft 34 due to the outer diameter of inner portion 80 of shaft cap 36 being larger than the inner diameter of shaft 34. Thus, shaft cap 36 connects securely to shaft and rotates with shaft 34 when ram air fan 10 is in operation.

Connecting motor rotor 25, thrust shaft 28, fan rotor 42, inlet shroud 44, bearing shaft 34 with shaft cap 36 (step 84) can be done with various connections such as interference fit connections, bolts or other methods. Connections must be secure so that all parts rotate together.

Next, tie rod 38 is placed through shaft cap 36 and through inlet shroud 44 (step 86) before stretching the tie rod (step 88). Tie rod 38 can be stretched using a machine that pulls on first end 56 and second end 58.

Fastening nut 60, 62 on threads on first end 56 of the tie rod 38 (step 90) and on second end 58 of the tie rod 38 (step 92) and releasing the stretch on the tie rod (step 94) secures the pre-load on tie rod 38. The pre-load on tie rod 38 clamps together parts of rotative assembly 21 to ensure secure connections and promote uniform rotation of rotative assembly 21.

The steps of stretching tie rod 38 (step 96); tightening nuts 60, 62 on the first and second ends of the tie rod 38 (step 98); and releasing the stretch on tie rod 38 (step 100) can be performed a second time to add more preload to tie rod 38.

In summary, forming shaft cap 36 separately from shaft 34 and connecting them with an interference fit allows for an easier forming of shaft cap 36 and shaft 34 and saves expense in the manufacturing process without sacrificing the ability to rotate together. Pilot 74 of shaft cap provides an interference connection without risking cracking through normal operating conditions due to outer lip 76, undercut portion 78 and inner portion 80. Additionally, the separate forming of shaft cap 36 and shaft 34 allows for more complex geometries in machining, allowing for a larger angle in the conical section of shaft cap 36 to better protect shaft 34 from debris in the airstream.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, dimensions and angles can be modified. Therefore, it is intended that the invention not be limited to the particular embodiment(s) disclosed, but that the invention will include all embodiments falling within the scope of the appended claims.

The invention claimed is:

1. A shaft cap to connect between a shaft and a tie rod on a rotative assembly, the shaft cap comprising:
   a circular portion with a central opening for connecting to the tie rod;
   a conical portion extending out from the circular portion at a slope; and
   a pilot around an outer edge of the conical portion, wherein the pilot comprises an outer lip to connect to an end of the shaft, an inner portion to connect to an inner circumference of the shaft and an undercut portion between the outer lip and the inner portion.

2. The shaft cap of claim 1, wherein the inner portion of the pilot comprises:
   an outer circumference to connect to the shaft; and
   a slanted edge around an end of the outer circumference.

3. The shaft cap of claim 2, wherein the slanted edge is slanted at an angle of about 28 degrees to about 32 degrees.

4. The shaft cap of claim 2, wherein the slanted edge extends about 0.030 inches (0.762 mm) axially along the shaft cap.

5. The shaft cap of claim 1, wherein the undercut portion of the pilot comprises a semi-circular channel located under the outer lip.

6. The shaft cap of claim 5, wherein an angle between the outer lip and the undercut portion is about 43 degrees to about 47 degrees.

7. The shaft cap of claim 1, where a dimension between a side of the outer lip that connects to the shaft and an end of the inner portion is about 0.265 inches (6.731 mm) to about 0.275 inches (6.985 mm).

8. The shaft cap of claim 1, wherein a radial distance from a center of the shaft cap to the outer edge of conical portion is about 1.759 inches (44.679 mm) to about 1.761 inches (44.729 mm).

9. The shaft cap of claim 1, wherein a radial distance from the center of the shaft cap to an outer edge of inner portion of the pilot is about 1.5655 inches (39.764 mm) to about 1.5665 inches (39.789 mm).

10. The shaft cap of claim 1, wherein the conical portion has an angle of about 48 degrees to about 52 degrees from vertical.

11. A shaft apparatus for a rotative assembly including a tie rod of a ram air fan, the shaft apparatus comprising:
   a shaft for rotating with the rotative assembly of a ram air fan; and
   a shaft cap to connect to an end of the shaft to rotate with the shaft, wherein the shaft cap comprises:
      a circular portion with a central opening for connecting to the tie rod;
      a conical portion extending out from the circular portion at a slope; and
      a pilot around an outer edge of the conical portion, the pilot with an outer lip to connect to the end of the shaft, an inner portion to connect to an inner circumference of the shaft and an undercut portion between the outer lip and the inner portion.

12. The shaft apparatus of claim 11, wherein the inner portion of the pilot comprises:
   an outer circumference to connect to the shaft; and
   a slanted edge around an end of the outer circumference.

13. The shaft apparatus of claim 11, wherein the undercut portion of the pilot comprises a semi-circular channel located under the outer lip.

14. The shaft apparatus of claim 13, wherein an angle between the outer lip and the undercut portion is about 43 degrees to about 47 degrees.

15. The shaft apparatus of claim 11, where a dimension between a side of the outer lip that connects to the shaft and an end of the inner portion is about 0.265 inches (6.731 mm) to about 0.275 inches (6.985 mm).

16. The shaft apparatus of claim 11, wherein a radial distance from a center of the shaft cap to the outer edge of conical portion is about 1.759 inches (44.679 mm) to about 1.761 inches (44.729 mm).

17. The shaft apparatus of claim 11, wherein a radial distance from the center of the shaft cap to an outer edge of the inner portion of the pilot is about 1.5655 inches (39.764 mm) to about 1.5665 inches (39.789 mm).

18. The shaft apparatus of claim 11, wherein the conical portion has an angle of about 48 degrees to about 52 degrees from vertical.

19. A motor-driven rotative assembly for a ram air fan, the rotative assembly comprising:
   a motor rotor to be rotated by a motor;
   a thrust shaft connected to the motor rotor to rotate with the motor rotor;
   a fan rotor connected to the thrust shaft to rotate with the thrust shaft;
   an inlet shroud connected to the fan rotor;
   a bearing shaft connected to the motor rotor to rotate with the motor rotor;
   a shaft cap connected to the bearing shaft;
   a tie rod connecting to the inlet shroud and to the shaft cap to ensure motor rotor, thrust shaft, fan rotor, bearing shaft and shaft cap all rotate together, wherein the shaft cap comprises:
      a circular portion with a central opening for connecting to the tie rod;
      a conical portion extending out from the circular portion at a slope; and
      a pilot around an outer edge of the conical portion, wherein the pilot comprises an outer lip to connect to an end of the shaft, an inner portion to connect to an inner circumference of the shaft and an undercut portion between the outer lip and the inner portion.

20. A method of installing a shaft cap with a circular portion with a central opening, a conical portion extending out from the circular portion at a slope and a shaft connection portion with an outer lip, an inner portion and an undercut portion between the outer lip and the inner portion; into a ram air fan rotative assembly, the method comprising:
   shrinking the shaft cap to have smaller dimensions than its natural state;
   placing the inner portion of shaft cap inside an end of a shaft to be rotated within the assembly so that the shaft cap outer lip sits outside of the shaft;
   allowing the shaft cap to expand so that the shaft cap is secured to the shaft by the inner portion securing to an inside circumference of the shaft and the outer lip is outside the end of the shaft;
   connecting a tie rod in through the central opening of the shaft cap; and
   assembling a nut on an end of the tie rod adjacent to the circular portion of the shaft cap.

* * * * *